US008273291B2

(12) United States Patent
Watanabe et al.

(10) Patent No.: US 8,273,291 B2
(45) Date of Patent: Sep. 25, 2012

(54) SILICON ALLOY, ALLOY POWDER THEREOF, MANUFACTURING APPARATUS, MANUFACTURING PROCESS AND SINTERED ALLOY THEREOF

(75) Inventors: Toshiyuki Watanabe, Tokyo (JP); Masafumi Matsushita, Yokohama (JP); Toshitaka Sakurai, Yokohama (JP); Kazuya Sato, Yokohama (JP); Yoko Matsushita, Yokohama (JP)

(73) Assignee: Sumikin Bussan Corporation, Osaka (JP)

( * ) Notice: Subject to any disclaimer, the term of this patent is extended or adjusted under 35 U.S.C. 154(b) by 656 days.

(21) Appl. No.: 12/407,300

(22) Filed: Mar. 19, 2009

(65) Prior Publication Data

US 2009/0185947 A1 Jul. 23, 2009

Related U.S. Application Data

(62) Division of application No. 11/788,243, filed on Apr. 19, 2007, now abandoned.

(30) Foreign Application Priority Data

Dec. 28, 2006 (JP) ..... 2006-354835

(51) Int. Cl.
*B22F 1/00* (2006.01)

(52) U.S. Cl. ..... 419/30; 419/13; 419/19; 419/23; 419/45; 419/56; 75/378; 75/330; 420/578; 420/580; 252/182.23; 252/182.32

(58) Field of Classification Search ..... 75/378; 419/30

See application file for complete search history.

(56) References Cited

U.S. PATENT DOCUMENTS 4,487,840 A * 12/1984 Raj et al. ..... 501/97.1
5,030,600 A * 7/1991 Hida et al. ..... 501/98.3
5,718,866 A * 2/1998 Richter et al. ..... 264/647

FOREIGN PATENT DOCUMENTS

JP 08-181279 7/1996
JP 2004-091272 A 3/2004
JP 2005-075652 3/2005
JP 2005-194154 7/2005
JP 2007-182334 7/2007
SU 1626601 A1 * 6/1995

OTHER PUBLICATIONS

"2006 Fine Ceramics Industry Trend Search" Japan Fine Ceramics, Dec. 6, 2006, Japan.

* cited by examiner

*Primary Examiner* — Roy King
*Assistant Examiner* — Christopher Kessler
(74) *Attorney, Agent, or Firm* — Howson & Howson LLP

(57) ABSTRACT

A controlled combustion synthesis apparatus comprises an ignition system, a pressure sensor for detecting internal pressure, a nitrogen supply, a gas pressure control valve for feeding nitrogen and exhausting reaction gas, means for detecting the internal temperature of the reaction container, a water cooled jacket, and a cooling plate. A temperature control system controls the temperature of the reaction container by controlling the flow of cooling water supplied to the jacket and the cooling plate in response to the detected temperature. By combustion synthesizing, while controlling the internal pressure and temperature, the apparatus can synthesize a silicon alloy including 30-70 wt. % silicon, 10-45 wt. % nitrogen, 1-40 wt. % aluminum, and 1-40 wt % oxygen.

4 Claims, 3 Drawing Sheets

SILICON ALLOY, ALLOY POWDER THEREOF, MANUFACTURING APPARATUS, MANUFACTURING PROCESS AND SINTERED ALLOY THEREOF

CROSS REFERENCE TO RELATED APPLICATION

This application is a division of application Ser. No. 11/788,243, filed Apr. 19, 2007, now abandoned, and claims priority from Japanese patent application No. 354835/2006, filed Dec. 28, 2006.

FIELD OF THE INVENTION

This invention relates generally to alloys based on silicon, and specifically to a silicon alloy, an alloy powder, a manufacturing apparatus, a manufacturing process, and a sintered alloy.

BACKGROUND OF THE INVENTION

Silicon is now in very limited use as an industrial material, and is used mainly as a silicon nitride ($Si_3N_4$) compound. For information on silicon nitride industrial materials, reference may be made to "2005 Fine Ceramics Industry Trend Search," Japan Fine Ceramics, published in November, 2005. However, silicon in the form of a silicon alloy has not yet been used as an industrial material in applications where its structural strength is relatively important.

Since silicon nitride is formed by a covalent bond of silicon and nitrogen in the uniform ratio of 3:4, impurities, especially metallic elements such as oxygen and iron, should not be included at all.

Material costs, and the cost of synthesis and processing of silicon nitride are extremely high, and consequently, the silicon nitride is yet to become an efficient form in which to utilize silicon as an industrial material.

SUMMARY OF THE INVENTION

In view of the above-described problems, we have carried out extensive investigations into a technique for synthesizing a silicon alloy from inexpensive metallurgical silicon, which can include impurities such as oxygen and iron, with the objective of utilizing the silicon alloy as an industrial structural material, i.e. as an industrial material for use in applications where the material's strength is important. As a result of our investigations, we have succeeded in synthesizing a silicon alloy by way of controlled combustion synthesis, and the synthesized silicon alloy can be utilized as an industrial structural material even though it contains quantities of solution elements, such as oxygen and iron.

By developing a new manufacturing technique, which combines a wet compound process and a sintering process, we also succeeded in producing a sintered silicon alloy comprising a silicon alloy powder the average particle diameter of which is kept under a specified value.

Specifically, the invention solved the aforementioned problems by means of a silicon alloy including 30-70 weight % silicon, 10-45 weight % nitrogen, 1-40 weight % aluminum and 1-40 weight % oxygen.

In addition, the invention provides a controlled combustion synthesis apparatus, comprising at least one ignition system, a pressure sensor for detecting the pressure in the apparatus, a nitrogen feed system for supplying nitrogen from the exterior, a pressure control system using a gas pressure control valve, which functions as a nitrogen feeder and an exhauster of reactant gas, a means for detecting the internal temperature of the reaction container, a first cooling system using a water-cooled jacket covering substantially the entire apparatus, and a second cooling system comprising a cooling plate installed in the apparatus. The apparatus further comprises a temperature control system which controls the internal temperature of the reaction container by controlling the flow of cooling water supplied to the first and second cooling systems in response to the temperature detected by the temperature detecting means. Thus combustion synthesis can be carried out with control of internal pressure and temperature, so the pressure and temperature are maintained specified values.

The invention further provides a process for manufacturing a sintered silicon alloy with combined use of a wet compound process and millimeter wave sintering. The process comprises a hydrous compounding step which uses, as a raw material, a silicon alloy powder the grains of which are composed of a silicon alloy including 30-70 weight % silicon, 10-45 weight % nitrogen, 1-40 weight % aluminum and 1-40 weight % oxygen, and have diameters less than or equal to 1 micron; a forming step to form an intermediate product or a final product; a drying step to reduce the amount of the included water to less than 1% by weight; a sintering step, in which green bodies formed in the forming and drying steps are heated, by millimeter waves at a frequency of at least 15 GHz, to a temperature within the range from 1300 to 1900 degrees Celsius for a time period in the range from 30 minutes to 3 hours, within a nitrogen atmosphere held to a pressure at least as high as atmospheric pressure. The forming step can be carried out with or without an inorganic binder, which, if used, is preferably a binder based on 0.1-10% by weight silicon and aluminum.

While vast quantities of silicon exist on the earth, almost all of the naturally occurring silicon is in the form of silicon dioxide, as desert sand for example. This invention makes it practical to utilize, silicon as a general purpose industrial structural material.

DETAILED DESCRIPTION OF THE PREFERRED EMBODIMENT

Figure 1:
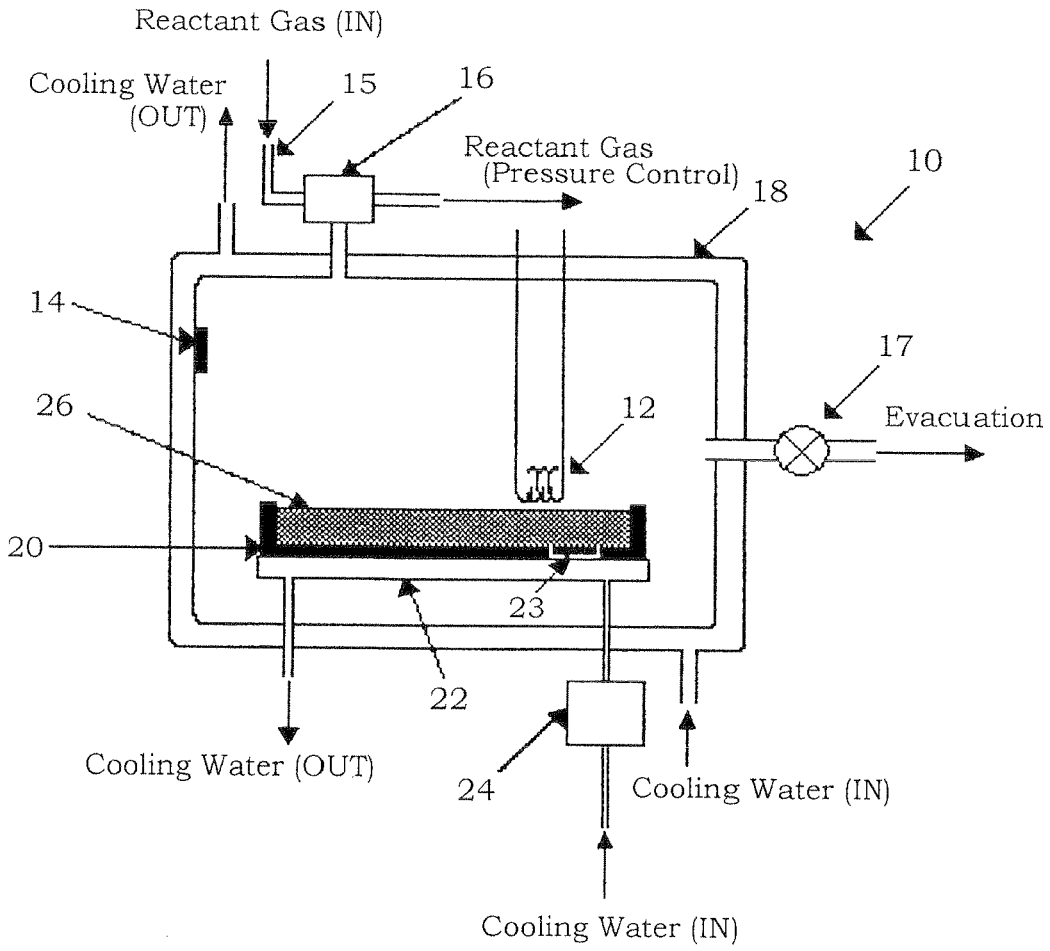
FIG. 1 is a block diagram of the controlled combustion synthesis apparatus of the invention.

The silicon alloy of the invention can be obtained, by putting nitrogen, along with the specified quantities of silicon powder and aluminum powder as the basis, into a controlled combustion synthesis apparatus along with specified quantities of silicon oxide and/or aluminum oxide, and a specified suitable quantity of at least one element from the group consisting of iron, nickel, chromium, molybdenum, manganese, titanium, yttrium, magnesium, calcium, zirconium, vanadium, boron, tungsten and cobalt. The controlled combustion synthesis apparatus that we developed can supply nitrogen continuously, and optionally under pressure, when needed. It can control the pressure and the temperature of the reaction, and can also carry out controlled cooling in the apparatus following the combustion synthesis reaction.

Inexpensive metallurgical silicon, recycled silicon and/or recycled aluminum can be employed as the silicon and/or aluminum components.

The metallurgical silicon, which is produced from silica or silica sand by normal electric furnace reduction refining, does not need to be expensive metallurgical silicon for semiconductors, which including very low amounts of oxygen. Instead, the metallurgical silicon, used as the material for the silicon alloy of this invention, can be inexpensive metallurgical silicon, including metallic elements such as iron, as well as relatively large quantities of oxygen as impurities.

The combustion synthesizer is used to carry out an exothermic reaction of the charged materials. Thus, no energy needs to be supplied to the synthesizer in order to carry out the reaction.

However, a problem with the synthesis of silicon alloys is that the apparatus needs to function and to be structured so that, as the combustion synthesis reaction takes place, it is resistant to high temperatures, which can exceed 3000 degrees Celsius, and pressures that can exceed atmospheric pressure by multiples as great as several decades. Furthermore, until now, there has been no control technology capable of controlling the combustion synthesis reaction in such a way as to achieve constant synthesis of stable compositions as products. Although small scale trials in laboratories have been attempted, the technology had not yet been put to practical use on an industrial scale.

We have expended many years in investigating the control of combustion synthesis, and have finally succeeded in developing the first controlled combustion synthesis apparatus which can keep the combustion synthesis reaction of silicon in a nitrogen atmosphere at a temperature under 2000 degrees Celsius and at a pressure under 1 MPa, and which can carry out controlled cooling of the combustion-synthesized products.

Using the controlled combustion synthesis apparatus, we succeeded, for the first time, in developing the solid-solution silicon alloy of the invention, based on the silicon and nitrogen. The silicon alloy of the invention was invented with the aid of the controlled combustion synthesis apparatus of the invention.

As shown in FIG. 1, the combustion synthesis apparatus 10 according to the invention is an enclosure having a number of features for carrying out combustion synthesis under prescribed conditions.

An evacuation system 17 is provided for exhausting air from the interior of the apparatus before combustion synthesis begins. At least one remotely controllable ignition device 12 is provided to ignite powder charged into the apparatus as a starting material. A pressure sensor 14 is provided for continually detecting the internal pressure of the apparatus as combustion synthesis proceeds.

A gas pressure control valve 16, responsive to the pressure sensor 14, controls the internal pressure of the apparatus by supplying nitrogen to the interior of the enclosure from an external nitrogen source (not shown) through a pipe 15, and by exhausting reactant gas to the exterior of the apparatus.

The enclosure is substantially completely covered on all sides by a water cooling jacket 18. In addition, a water-cooled cooling plate 22 is provided underneath, and close to the bottom of, a reaction container 20 in which the charge of material 26 is held.

A temperature detector 23, located in the reaction container, controls the aperture of a flow control valve 24, through which cooling water is delivered to the cooling plate 22. Thus, the temperature of the cooling plate is regulated automatically by controlling the flow of cooling water. Although not shown, another automatically controllable flow control valve can be provided to control the flow cooling water into the jacket 18. This additional flow control valve can also be made responsive to the temperature detector 23 so that temperature control can be carried out by regulating the flow of cooling water into the cooling plate, into the cooling jacket, or both into the cooling plate and into the cooling jacket. Optionally, a supplemental heating apparatus (not shown) may be installed in the enclosure to provide additional heat in case of excessive cooling.

In the operation of the apparatus, as a first step, air is exhausted from the interior of the enclosure through evacuation system 17, which includes a suitable pump (not shown), in order to produce a vacuum in the enclosure. Next, nitrogen from an external source is supplied to the interior of the enclosure through pipe 15 and gas pressure control valve 16. When a specified quantity of nitrogen has been introduced, as indicated by the pressure sensed by sensor 14, the ignition device 12 ignites the starting material 26, which is a powder composed of metallurgical silicon, aluminum, alumina, and/or silica, all present in proportions by weight suitable to produce the desired silicon alloy.

The reaction is controlled by regulating the pressure and temperature inside the enclosure, using the pressure sensor 14 for controlling the introduction of nitrogen and the exhaustion of the reactant gas, and using the temperature detector 23 to control the flow of cooling water to one or both of the cooling jacket 18 and the cooling plate 22. Thus, combustion synthesis is carried out while the internal pressure of the apparatus, and the temperature in the reaction container 20, are maintained at specified levels.

Figure 2:
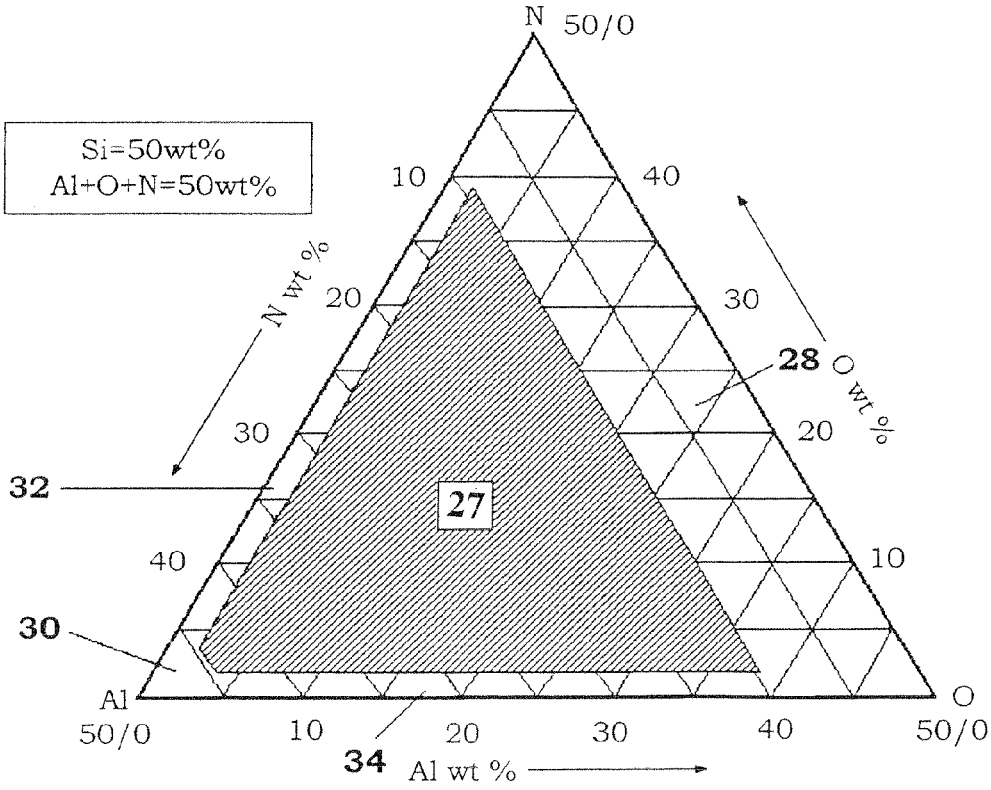
FIG. 2 is a ternary diagram for nitrogen/aluminum/oxygen showing the formation region of a silicon alloy containing 50 by weight % of silicon.

The ternary diagram of FIG. 2 shows an operating region 27 for aluminum, nitrogen and oxygen in an alloy in which the silicon content constitutes 50 wt %, and the remainder, consisting of aluminum, nitrogen and oxygen, constitutes 50 wt %. X-ray diffraction analysis has confirmed that the region 27 is a complete solid solution, single phase composition based on silicon.

Moreover, we have confirmed that the complete solid solution region 27 does not vary, even when up to 0.3% by weight of one or more elements, from the group consisting of iron, nickel, chromium, molybdenum, manganese, titanium, yttrium, magnesium, calcium, zirconium, vanadium, boron, tungsten and cobalt, is included as unavoidable impurities. Thus, we have verified that these unavoidable impurity elements will become part of a complete solid solution along with the silicon, nitrogen, aluminum and oxygen.

A complete solid solution single phase composition region has also been specified as the composition region of the silicon alloy of the invention for 70%, 40%, and 30%, by weight %, of silicon.

We have also identified a complete solid solution, single phase, composition region, in which 0.3-10% by weight of at least one element from the group consisting of iron, nickel, chromium, molybdenum, manganese, titanium, yttrium, magnesium, calcium, zirconium, vanadium, boron, tungsten and cobalt has been added.

In the region 28, 30, 32, and 34 indicated in FIG. 2, i.e., the regions outside of the shaded composition region 27, a metal oxide compound, or a complex acid nitride compound is generated. The metal oxide compound and the complex acid nitride compound cannot become a solid solution with the silicon alloy.

Expressing the above in quantitative terms, in a composition in which silicon is less than 30 wt % or greater than 70 wt %, or nitrogen is less than 10 wt % or greater than 45 wt %, or aluminum is less than 1 (should 1 be 5?) wt % or greater than 40 wt %, or oxygen is less than 1 wt % or greater than 40 wt %, a complex compound coexists with, and embrittles, the silicon alloy.

Each of the elements from the group consisting of iron, nickel, chromium, molybdenum, manganese, titanium, yttrium, magnesium, calcium, zirconium, vanadium, boron, tungsten and cobalt becomes part of the solid solution of the silicon alloy, and functions to improve the hardness, rigidity, heat resistance, and corrosion resistance of the silicon alloy. When the total added amount of these elements is less than 0.3° by weight, their effect is negligible. On the other hand, when the total added amount is equal to or greater than 10% by weight complex compounds are generated. Therefore, the total adding amount of the above-mentioned elements is preferably at least 0.3% by weight, but less than 10% by weight.

A powdering operation is carried out in order to make the combustion-synthesized silicon alloy into an intermediate or final product. It is preferable that the powdering process be carried out in such a way as to produce a predetermined grain diameter in a short time, and silicon alloy combustion-synthesis carried out under a low controlled temperature and pressure requires relatively little time for powdering into a predetermined grain diameter.

More specifically, the time required for powdering a combustion-synthesized silicon alloy to a predetermined grain diameter can be shortened by as much as 50% or more by utilizing a low combustion synthesis temperature, preferably less than 2000 degrees Celsius and combustion synthesis pressure under 1 MPa, instead of a conventional combustion synthesis temperature greater than 2000 degrees Celsius and a pressure of more than 1 MPa.

We have found that the optimum sintering temperature for a combustion-synthesized alloy produced at a combustion synthesis temperature under 2000° C. and a pressure under 1 MPa is as much as 100 degrees Celsius lower than the sintering temperature of a conventionally produced silicon alloy.

Figure 3:
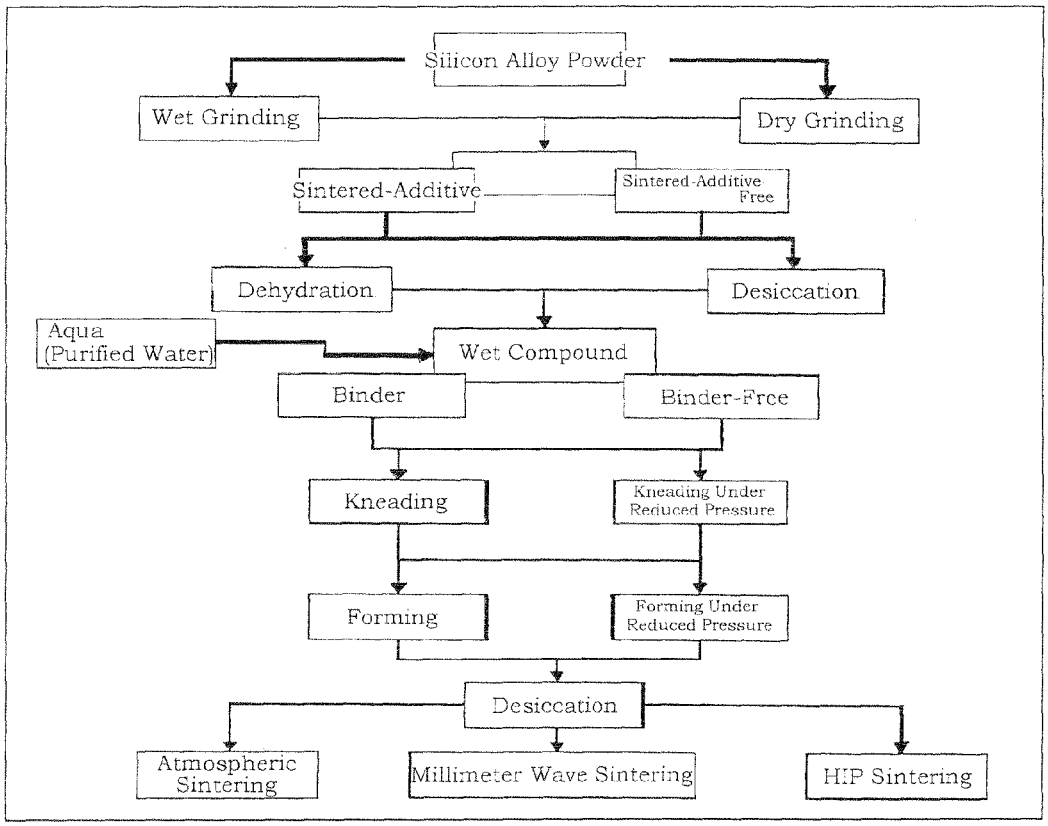
FIG. 3 is a block diagram illustrating the process of making a sintered alloy according to the invention.

FIG. 3 depicts the manufacturing process according to the invention, wherein a wet compound process and a sintering process are combined to produce shaped, sintered intermediate products or final products from the silicon alloy of the invention.

The term "micro pore" as used herein refers to a minute hole detectable at a microscopic level. In producing the sintered silicon alloy of the invention, it is important to reduce micro pores remaining in the sintered products as much as possible. The best way to solve the problem of micro pores is the silicon alloy sintering process of the invention using a combination of a wet compound processing and sintering using one or more of the following sintering processes: atmospheric sintering, millimeter wave sintering, and HIP (Hot Isostatic Press) sintering.

In addition, the above described sintering processes can be applied effectively to non-electroconductive powder bodies other than the silicon alloy.

The silicon alloy of the invention, synthesized by a controlled combustion synthesis apparatus, is preferably powdered into a grain diameter of less than 1 micron using a wet and/or a dry powdering apparatus. It is desirable to produce a powder in which the particles have an average diameter less than 500 nm in order to improve the relative density of the material after the millimeter wave sintering.

When powdering, or before and after powdering, 0.1-10 by weight % of an oxide of yttrium, ytterbium, aluminum or zirconium, or a mixture of one or more such oxides, can be mixed into the silicon alloy as a sintering additive for more effective sintering. As the average grain diameter becomes smaller, less additive is necessary. A grain diameter of less than 500 nm produces a high density sintered compact without additives, typically having a specific gravity of more than 3.27.

A compound may be made by adding a binder and water, in some cases distilled water or purified water, to a fine ground powder, and kneading by means of a kneader. It is unnecessary to add a binder if the powder body has a grain diameter less than 500 nm.

When a binder is used, an inorganic binder is preferable, and an inorganic binder based on the main composition elements of the silicon alloy of the invention, i.e., silicon and aluminum, is optimum for the silicon alloy of the invention. In addition, to improve the dispersibility of the inorganic binder, water having a controlled pH on the alkaline side may be used.

Green formed bodies composed of a compound without the addition of a binder has the advantage that binder removal treatment, usually carried out becomes unnecessary.

It is possible to reduce the unavoidable micro pores during compounding to minimum by carrying out kneading and/or forming under a reduced pressure, less than or equal to atmospheric pressure.

Therefore, to produce a sintered silicon alloy for use where an especially strengthened alloy is required, the above described wet compound formation process is desirable. After formation, the compact, in which the micro pores are minimized, is dried, preferably by air drying.

The green formed bodies produced by the above-described processes are heated at a predetermined temperature, and for a predetermined time, in a nitrogen atmosphere at a pressure held equal to or greater than atmospheric pressure, by millimeter wave heating means, conventional resistance heating means, HIP heating means, or a combination of one or more such heating means, to produce a sintered silicon alloy. Preferably, sintering is carried out at a temperature in the range of 1300-1900 degrees Celsius, for a heating period from 30 minutes to 3 hours.

In millimeter wave heating, the centers of the green formed bodies are the first areas to be heated. As a result, included micro pores move to the surface of the formed products. Therefore, the millimeter wave sintering process is the optimum sintering process for minimizing micro pores.

In millimeter wave heating, since heat moves from the core to the exterior of the heated materials, it is important to prevent heat desorption from the heated material as much as possible. For this purpose, heat insulating materials should be arranged on the outer peripheries of the heated materials. However, to avoid the troublesome insulating operation, a hybrid sintering process, which combines millimeter wave heating and general-purpose heating, is recommended.

The following table 1 shows the chemical composition and the composition phase of the silicon alloy composed by the combustion synthesis means of the invention, the reaction temperature and pressure of which is kept under 2000 degrees Celsius and 1 MPa respectively.

TABLE 1

| Main alloy element (% by weight) | | | | | Alloy element (% by weight) | | | AND determination result | |
|---|---|---|---|---|---|---|---|---|---|
| Examples | Si | N | Al | O | Element 1 | Element 2 | Element 3 | Single Phase Composition | Complex Phase Composition |
| Inventive Example 1 | 69.9 | 10.5 | 4.5 | 15.1 | | | | yes | |
| I.E 2 | 65.5 | 12.3 | 6.5 | 15.7 | Fe 0.2 | Ca 0.11 | | yes | |
| I.E 3 | 62.8 | 15.3 | 8.5 | 13.4 | | | | yes | |
| I.E 4 | 58.5 | 39.3 | 1 | 1.2 | | | | yes | |
| I.E 5 | 56.4 | 32.4 | 10.1 | 1.1 | | | | yes | |
| I.E 6 | 55.1 | 35.3 | 4.7 | 4.9 | Fe 0.25 | Ca 0.04 | | yes | |
| I.E 7 | 50.9 | 10.4 | 1.1 | 16.6 | | | | yes | |
| I.E 8 | 50.4 | 33.7 | 4.3 | 18.5 | | | | yes | |
| I.E 9 | 50.3 | 35.1 | 5.4 | 19.2 | Fe 0.15 | Ca 0.05 | | yes | |
| I.E 10 | 50.7 | 39.3 | 8.9 | 1.1 | Fe 0.20 | Ca 0.06 | | yes | |
| I.E 11 | 49.6 | 22.3 | 10.8 | 17.3 | Fe 0.20 | Ca 0.06 | | yes | |
| I.E 12 | 50 | 10.5 | 38.4 | 1.1 | | | | yes | |
| I.E 13 | 49.4 | 10.3 | 1.1 | 39.2 | | | | yes | |
| I.E 14 | 49.1 | 10 | 39.6 | 1.3 | | | | yes | |
| I.E 15 | 48.7 | 19.1 | 7.6 | 24.6 | Fe 0.23 | Ca 0.05 | | yes | |
| I.E 16 | 50.7 | 29.1 | 2.6 | 17.6 | | | | yes | |
| I.E 17 | 40.7 | 40 | 16.7 | 2.6 | | | | yes | |
| I.E 18 | 40.3 | 34.6 | 23.9 | 1.2 | Fe 0.22 | Ca 0.04 | | yes | |
| I.E 19 | 40.2 | 39.7 | 1.1 | 19 | | | | yes | |
| I.E 20 | 39.8 | 19.2 | 39.9 | 1.1 | | | | yes | |
| I.E 21 | 40.1 | 18.8 | 1.8 | 39.3 | Fe 0.18 | Ca 0.05 | W 0.05 | yes | |
| I.E 22 | 30.3 | 10 | 40 | 19.7 | | | | yes | |
| I.E 23 | 32.1 | 20.8 | 34.8 | 12.3 | | | | yes | |
| I.E 24 | 30.1 | 39.7 | 15 | 15.2 | | | | yes | |
| I.E 25 | 30.5 | 38.9 | 29.5 | 1.1 | | | | yes | |
| I.E 26 | 30.2 | 29.3 | 39.5 | 1 | | | | yes | |
| I.E 27 | 30.1 | 29.3 | 1.2 | 39.4 | Fe 0.25 | Ca 0.04 | | yes | |
| I.E 28 | 30.3 | 24.3 | 15.2 | 30.2 | Fe 0.35 | | | yes | |
| I.E 29 | 54.8 | 35.3 | 4.7 | 3.7 | Fe 0.3 | Y 1.2 | | yes | |
| I.E 30 | 54.3 | 34.3 | 5.4 | 5.6 | Mo 0.3 | Ti 0.3 | | yes | |
| I.E 31 | 54.6 | 35.1 | 4.7 | 4.7 | Fe 0.2 | Zr 0.6 | V 0.1 | yes | |
| I.E 32 | 54.5 | 33.3 | 4.6 | 5.4 | Fe 0.4 | Mg 0.5 | CR 1.3 | yes | |
| I.E 33 | 54.7 | 35.3 | 4.5 | 4.2 | Fe 0.3 | Ca 0.3 | | yes | |
| I.E 34 | 54.1 | 35.1 | 4.9 | 5.59 | Fe 0.4 | B 0.01 | | yes | |
| I.E 35 | 54.8 | 35 | 5.7 | 4.4 | Fe 0.1 | W 0.3 | | yes | |
| I.E 36 | 54.2 | 34.3 | 5.3 | 6 | Fe 0.2 | Co 0.15 | | yes | |
| I.E 37 | 53.8 | 32.3 | 4.9 | 3 | Fe 2.5 | Ni 3.5 | | yes | |
| I.E 38 | 54.9 | 35.3 | 4.7 | 4 | Fe 1.1 | | | yes | |
| Comparative Example 1 | 71.9 | 7.5 | 4.5 | 16.1 | | | | | yes |
| C.E 2 | 26.4 | 32.4 | 10.1 | 31.1 | | | | | yes |
| C.E 3 | 50.4 | 7.7 | 18.3 | 23.6 | | | | | yes |
| C.E 4 | 50.7 | 44.1 | 2.6 | 2.6 | | | | | yes |
| C.E 5 | 40.7 | 40 | 16.7 | 2.6 | | | | | yes |
| C.E 6 | 30.1 | 41.7 | 15 | 13.2 | | | | | yes |
| C.E 7 | 50.1 | 8.7 | 15 | 25.9 | Fe 0.3 | | | | yes |

In the above table, examples 1-38 are examples of the invention. All of these examples were shown by x-ray diffraction studies to have single phase compositions.

Using an electron probe microanalyzer (EPMA), each of examples 1 to 28 was identified as a solid solution composed of four elements: silicon, nitrogen, aluminum and oxygen. These examples are representative of the basic composition of the silicon alloy of the invention.

Examples 29-38 are the examples in which alloy elements were added to the basic composition of the silicon alloy, and every alloy element is part of a solid solution with the basic composition.

The basic composition of the invention is defined as composed of 30-70 wt % silicon, 10-45 wt % nitrogen, and 1-40 wt % aluminum, and 1-40 wt oxygen in order to obtain a single phase silicon alloy composition.

For the purpose of improving the properties of the silicon alloy of the basic composition, 0.3 to 10% by weight of at an additive may be added as a subsidiary alloy element or as subsidiary alloy elements. This additive may consist of at least one element, i.e., one or more elements, from the group consisting of iron, nickel, chromium, molybdenum, manganese, titanium, yttrium, magnesium, calcium, zirconium, vanadium, boron, tungsten and cobalt. As mentioned previously, the addition of less than 0.3 wt % does not work effectively and the addition of more than 10 wt % causes complex phase compositions to be produced.

Temperature and pressure in the combustion synthesis process have an influence over the properties of the silicon alloy. The following table 2, for example, shows the effect of temperature and pressure on an alloy having the chemical composition of inventive example 6 in table 1.

Table 2 shows the relationship between the times required for powdering the alloy into grain diameters of 500 nm for various pressure and temperature conditions during the combustion synthesis.

At a low pressure of 1800° C. and a low pressure of 0.8 Mpa, for example, the powdering process takes only one fifth as long to achieve the same result as at a temperature of 2000° C. and a pressure of 1 MPa, and only one tenth as long to achieve the same result as at a temperature of 2500° C. and a pressure of 2 MPa. Therefore, a temperature of 1800° C. and a pressure of 0.8 MPa is clearly preferable.

TABLE 2

| Pressure in Combustion Synthesis (Mpa) | Temperature in Combustion Synthesis (° C.) 1800 | 2000 | 2500 |
|---|---|---|---|
| 0.8 | 10 | | |
| 1 | | 50 | |
| 2 | | | 100 |

Table 3, below, shows the relationship between the optimum sintering temperature and the temperature and pressure conditions of the combustion synthesis, determined in terms of density and grain growth in the product following sintering.

As shown by the table, the optimum sintering temperature is lower when the temperature and pressure at which combustion synthesis is carried out are lower. Here again, the combustion synthesis conditions of 1800° C. degrees and 0.8 MPa are preferable, resulting in an optimum sintering temperature of 1600° C.

TABLE 3

| Pressure in Combustion Synthesis (Mpa) | Temperature in Combustion Synthesis (° C.) 1800 | 2000 | 2500 |
|---|---|---|---|
| 0.8 | 1600° C. | | |
| 1 | | 1700° C. | |
| 2 | | | 1800° C. |

Table 4, below, shows the variation of the main characteristic values, i.e., Young's modulus, fracture toughness, corrosion resistance, and heat resistance, of the alloy with variation of the major components of the silicon alloy. As shown by the table, Young's modulus varies greatly with variations in the amount of silicon. The Young's modulus is an important characteristic value, having influence on fatigue strength, an important factor in the design of a machine component.

Despite the conventional notion that the Young's modulus of a material is the material's own characteristic value, the Young's modulus of the silicon alloy according to the invention can be varied over the relatively wide range shown by table 4, by selection of an appropriate silicon content.

In the case of two machine components that come into rolling contact with each other, for example, an optimum Young's modulus for one of the components can be easily selected to correlate with the Young's modulus of the material of the other component. Accordingly, the ability to select the Young's modulus of the material is potentially of extreme value in machine design.

Table 4 also shows that the addition of boron, which, as an alloy element affects grain boundary energy, improves the fracture toughness of the alloy. The table also shows that the addition of non-oxide metallic elements such as nickel or nickel together with molybdenum, improves resistance to corrosion and heat.

TABLE 4

| Silicon Weight % | | 55 | | 50 | | 45 | | 40 | | 35 | |
|---|---|---|---|---|---|---|---|---|---|---|---|
| Basic Composition | Addition of Alloy Element | — | 0.1B | — | 0.1B | — | 1.5Ni | — | 1Ni + 1Mo | — | 1Ni + 1Mo |
| Young's Modulus (GPa) | | 290 | 290 | 260 | 260 | 240 | 230 | 210 | 200 | 180 | 170 |
| Fracture Toughness, K1c (MPa $\sqrt{m}$) | | 6 | 7.5 | 6 | 7.5 | 7 | 7 | 7 | 7 | 8 | 8 |
| Corrosion Resistance* | | 1 | 1 | 1 | 1 | 2 | 3 | 3 | 4 | 4 | 5 |
| Heat Resistance* | | 1 | 1 | 1 | 1 | 2 | 3 | 3 | 4 | 3 | 4 |

*Index display of the relative superiority and inferiority degree of the characteristics: Inferior 1 < 2 < 3 < 4 < 5 Superior Table 5 summarizes the sintering behavior of the silicon alloy of the invention. Because of its crushability, the silicon alloy of the invention can be ground into an ultra fine powder having a particle diameter of less than or equal to 500 nm at a low cost. This feature gives rise to new characteristics which could not have been recognized in a conventional alloy.

TABLE 5

| Article | | Average Particle Diameter (nm) 5000 | 1000 | 700 | 500 | 300 |
|---|---|---|---|---|---|---|
| Necessity of Binder in Compounding | | Yes | Yes | Yes | No | No |
| Necessity of Sintering Additive | | Yes | Yes | Yes | No | No |
| Specific GravityAfter Sintering | Millimeter wave heating Nitrogen atmosphere Atmospheric sintering (1700° C. × 1 h) | 2.85 | 2.9 | 3.2 | 3.27 | 3.28 |
| | Normal heating Nitrogen atmosphere Atmospheric sintering (1700° C. × 3 h) | 2.65 | 2.75 | 3.15 | 3.25 | 3.27 |
| | CIP + nitrogen atmosphere 200 MPa HIP (1700° C. × 1 h) | 2.85 | 2.95 | 3.15 | 3.27 | 3.27 |
| Maximum Diameter of Micro Pore After Sintering (μm)* | Millimeter wave heating Nitrogen atmosphere atmospheric sintering (1700° C. × 3 h) | 5/5 | 3/3 | 0.8/0 | 0/0 | 0/0 |
| | Normal heating nitrogen atmosphere Atmosphere | 10/10 | 5/5 | 2/2 | 0/0 | 0/0 |

TABLE 5-continued

| Article | | Average Particle Diameter (nm) 5000 | 1000 | 700 | 500 | 300 |
|---|---|---|---|---|---|---|
| | sintering (1700° C. × 3 h) | | | | | |
| | CIP + nitrogen atmosphere 200 MPa HIP (1700° C. × 1 h) | 7/7 | 2/1 | 0.9/0.6 | 0/0 | 0/0 |
| Presence of Metallic Phase after Sintering** | Millimeter wave heating Nitrogen atmosphere Atmospheric sintering (1700° C. × 1 h) | No | No | No | No | No |
| | Normal heating nitrogen atmosphere atmospheric sintering (1700° C. × 3 h) | No | No | No | No | No |
| | CIP + nitrogen atmosphere 200 MPa HIP (1700° C. × 1 h) | No | No | No | No | No |
| Presence of Ceramics Heterogenous Phase After Sintering** | Millimeter wave heating Nitrogen atmosphere atmospheric sintering (1700° C. × 1 h) | No | No | No | No | No |
| | Normal heating nitrogen atmosphere Atmospheric sintering (1700° C. × 3 h) | No | No | No | No | No |
| | CIP + nitrogen atmosphere 200 MPa HIP (1700° C. × 1 h) | No | No | No | No | No |

*With or without vacuum treatment operation in compounding

**Regardless of with or without vacuum treatment operation in compounding.

It is preferred that a compounding operation intervene between the powdering of the silicon alloy and the production of a basic shape. The compounding operation ensures higher productivity than corning of the dry powder.

The process for producing a basic shape is shown in FIG. 3. If the grain diameter is equal to or less than 500 nm, it is unnecessary to add a binder when compounding. As a result, a subsequent binder removal process can be omitted, and improvement in productivity and quality can be achieved.

An inorganic binder based on 0.1-10% by weight silicon and aluminum may be added for the purpose of securing manufacturing stability.

No addition of sintered additives is necessary if the grain diameter is equal to or less than 500 nm. However, for stable quality, 0.1-10 by weight % of at least one oxide based on yttrium, ytterbium, aluminum or zirconium may be added as minimum sintering additives.

The following are examples of three kinds of sintering treatments that can be utilized for the silicon alloy: (A) millimeter wave heating, nitrogen atmosphere, atmospheric sintering, 1700° C. for 1 hour; (B); conventional heating, nitrogen atmosphere, atmospheric sintering, 1700° C. for 3 hours; (C) CIP (Cold Isostatic Pressing), nitrogen atmosphere 200 MPa, HIP, 1700° C., 1 hour.

From the viewpoint of low cost manufacturing, it is important to be able to form a high-grade sintered basic shape using atmospheric sintering, and sintering treatment B.

Every silicon alloy having a grain diameter less than 500 nm can be made to have a specific gravity more than 3.25 in all the sintering treatments. It is worth noting that the specific gravity of the silicon alloy obtained in the atmospheric sintering process B surpasses that of HIP sintering C of a non-oxide ceramic silicon nitride.

For all the sintering treatments of silicon alloys no micro pores were found in a wide area microscopic observation, where the grain diameter was less than 500 nm. Nor were a metallic phase or a ceramic heterogeneous phase found.

It can be concluded that the reason why the fine sintering behavior is obtained in every sintering treatment is that the impalpable silicon alloy powder, having a grain diameter less than 500 nm, is itself superior in sintering behavior.

The object of the invention is to utilize silicon, the largest deposit in the earth's crust, as a general-purpose industrial material.

Summarized in table 6 are comparisons in the characteristics and assumed manufacturing costs of silica ceramics currently in industrial use, such as silicon nitride and SIALON, and the materials of the invention. SIALON is more expensive in basic shape manufacturing cost, since it utilizes an expensive reactive sintering process using a material having the same price as that of silicon nitride. Therefore, the information on SIALON is presented only for reference.

The most distinctive difference in the characteristics of the materials of table 6 is in the micro pores which remain after sintering. In the silicon alloy of the present invention, no micro pores remain at all, while micro pores unavoidably remain in silicon nitride. The absence of micro pores makes the specific gravity of the alloy of the present invention greater than that of silicon nitride.

Taking ball bearing manufacture as an example of a manufacturing process using the sintered basic shape, the manufacturing cost ratio for ball bearings of the present invention, silicon nitride ball bearings, and SIALON ball bearings is shown, where the manufacturing cost of a special steel bearing ball is used as a reference and assigned a cost value of 1.

TABLE 6

| | | Article: Central Value of the Present Inventive Examples | | | SIALON*1 | Silicon Nitride*2 | Bearing Steel*3 (quenching And |
|---|---|---|---|---|---|---|---|
| Sintering Condition | | A*4 | B*5 | C*6 | HIP | HIP | Tempering) |
| Specific Gravity | | 3.27 | 3.25 | 3.27 | 3.2 | 3.0./3.4 | 7.9 |
| Microstructure | | | | | | | |
| Bulk of Micro Pore | μm | 0 | 0 | 0 | <10 | 10/25 | 0 |

TABLE 6-continued

| | | Article | | | | | |
|---|---|---|---|---|---|---|---|
| | | Central Value of the Present Inventive Examples | | | SIALON*1 | Silicon Nitride*2 | Bearing Steel*3 (quenching And |
| Sintering Condition | | A*4 | B*5 | C*6 | HIP | HIP | Tempering) |
| Bulk of Metallic Phase | μm | 0 | 0 | 0 | <10 | 10/25 | 0 |
| Bulk of Ceramics Heterogenous Phase | μm | 0 | 0 | 0 | <25 | <25 | 0 |
| Flexural Strength | | | | | | | |
| 3 point | MPa | 750 | 750 | 750 | — | 600/900 | — |
| 4 point | MPa | — | — | — | — | 400/700 | — |
| Young's Modulus GPa | | 180~260 | 180~260 | 180~260 | 260 | 270/330 | 210 |
| Poisson's Ratio | | — | — | — | — | 0.23/0.29 | — |
| Hardness HV5 | | 1500 | 1500 | 1500 | 1450 | 1350/1500 | 750 |
| Fracture Toughness, Klc MPa $\sqrt{m}$ | | 6 | 6 | 6 | — | 5.0/6.0 | — |
| Fatigue Characteristics, $L_{10}$ Life Time | n | 4.0E+07 | 4.0E3+07 | 4.0E+07 | — | 1.0E+07 | >1.0E+08 |
| Heat Conductivity | W/m-K | — | — | — | 65 | 20/38 | 30 |
| Heat Capacity | J/kg-K | — | — | — | — | 630/800 | — |
| Coefficient of Linear Expansion $\times 10^6$ | | — | — | — | — | 2.8/4.0 | 12.5 |
| Magnetic Properties | | nonmagnetic | | | nonmagnetic | nonmagnetic | ferromagnetic |
| Electrical Resistivity | Ohm-m | — | — | — | $>10^{13}$ | $10^{10}/10^{16}$ | — |
| Crush Intensity | MPa | 2500 | 2500 | 2500 | 1050 | 3000 | 1960 |
| Material Structure | | complete solid solution | | | — | compound | solid solution |
| Cost Ratio*7 | Material | <10 | <10 | <10 | — | <100 | 1 |
| | Product | <10 | <5*8 | <10 | >100 | <100 | 1 |

*1Reaction sintering material
*2ASTM, F2094-01
*3Super clean bearing steel. oxygen < 10 ppm
*4Millimeter wave heating - Nitrogen normal pressure - 1700° C. × 1 h
*5Normal heating - Nitrogen normal pressure - 1700° C. × 3 h
*6CIP(200 MPa) + HIP(200 MPa nitrogen, 1800° C. × 1 h)
*7Based on bearing ball manufacturing cost
*8Compound + High-speed pill manufacturing apparatus + Normal Pressure continuous sintering oven The features that influence the cost of the material powder are as follows.

(1) Metallurgical silicon as the main material for the process of the invention is a low cost material, while the metallurgical silicon used for silicon nitride is an expensive, high-grade, material.

(2) Zero energy is used in the combustion synthesis process.

(3) With the invention, the powdering cost is low because of the fine crushability of the material. In contrast, the cost of powdering silicon nitride currently in use is high because of its poor crushability.

(4) The differences in the manufacture process, result in a huge cost difference between the 500 nm silicon alloy powder of the invention and silicon nitride powder.

(5) As a result, the production of the basic shape according to the invention costs only about one tenth of the cost of production of a corresponding basic shape from silicon nitride.

The silicon alloy of the invention is also superior from the standpoint of the cost of manufacturing ball bearings as basic shapes.

(1) A green basic ball of a bearing ball can be produced efficiently from the compound of 500 nm impalpable powder using a high-speed forming apparatus. The high-speed forming apparatus is based on a pill manufacturing apparatus and was improved and adjusted so that it was suitable for ball bearings produced in accordance with the invention. The forming apparatus can manufacture 3000 products per minute. In the same one minute, about 700 of bearing steel basic balls can be produced but only several tens of silicon nitride basic balls can be produced.

(2) A nitrogen atmospheric sintering process, using a conventional heating means, can be applied to the sintering process of the green basic balls of the invention. This results in the much lower manufacturing cost compared to the cost of HIP sintering of silicon nitride.

(3) As a result, the cost for manufacturing the bearing balls of the present invention using the above operations (1) and (2) is less than 5 times that for special steel balls.

The specific gravity of the sintered material of the present invention is 40% of the specific gravity of special steel. Thus, if the specific gravities are taken into account by conversion, so that the manufacturing costs are based on specific gravity, the cost of manufacturing bearing balls according to the invention is only about two times higher than the cost of manufacturing special steel balls. Therefore, it is possible that when ball bearings made from the silicon alloy of the invention are mass-produced, they will be used as substitutes for special steel ball bearings.

The silicon alloy of the invention may also replace special steel and be utilized in bulk, especially as a general purpose industrial material. In the future, 2 million tons of annual demand is expected for the material of the invention, which corresponds to 10% of the 20 million tons of annual production of the special steel.

What is claimed is:

1. A controlled combustion synthesis process comprising:

introducing, into a reaction container within an apparatus forming an enclosure, a starting material comprising a mixture including silicon powder, aluminum, and one or more substances from the group consisting of alumina and silica;

exhausting air from said apparatus;

supplying nitrogen to said apparatus from the exterior thereof by means of a nitrogen feed system including a gas pressure control valve;

detecting the internal pressure within said apparatus by means of a pressure sensor, and thereby determining the quantity of nitrogen in said apparatus;

initiating a reaction in said starting material by igniting said starting material, by means of at least one ignition system, when a predetermined quantity of nitrogen has been introduced into said apparatus as determined by said pressure sensor;

detecting the internal temperature of the reaction container by temperature detection means; and controlling said reaction by:

regulating the pressure within said apparatus by introducing nitrogen into the reaction container and exhausting reactant gas therefrom by means of said pressure control valve in response to said pressure sensor;

controlling the temperature of said reaction container by regulating the flow of cooling water through a cooling system comprising a water-cooled jacket covering substantially the entire apparatus in response to the temperature as detected by said temperature detection means; and controlling the temperature of said cooling plate by regulating the flow of cooling water through said cooling plate in response to the temperature as detected by said temperature detection means;

whereby combustion synthesis of a silicon alloy is carried out while maintaining the internal pressure within said apparatus and the temperature of said reaction container at specified values.

2. A process according to claim 1, in which said mixture also includes at least one element from the group consisting of iron, nickel, chromium, molybdenum, manganese, titanium, yttrium, magnesium, calcium, zirconium, vanadium, boron, tungsten and cobalt.

3. A process according to claim 1, in which the internal pressure within said apparatus is maintained at a pressure not exceeding 1 MPa, and the internal temperature of said reaction container is maintained at a temperature not exceeding 2000 degrees Celsius.

4. A process for manufacturing a silicon sintered alloy comprising:

making a combustion-synthesized silicon alloy by the process according to claim 1;

carrying out a hydrous compounding step which uses, as a raw material, a powdered combustion-synthesized silicon alloy made by the process of claim 1, the grains of said powder including 30-70 weight silicon, 10-45 weight % nitrogen, 1-40 weight % aluminum and 1-40 weight % oxygen, and having diameters less than or equal to 1 micron;

forming the hydrous compounded powder into an intermediate product; carrying out a drying step to reduce the amount of the included water in said intermediate product to less than 1% by weight; and a sintering step in which green bodies formed in the forming and drying steps are heated, by millimeter waves at a frequency of at least 15 GHz, to a temperature within the range from 1300 to 1900 degrees Celsius for a time period in the range from 30 minutes to 3 hours, within a nitrogen atmosphere held to a pressure at least as high as atmospheric pressure.

* * * * *